US009807537B2

(12) United States Patent
Yuyama et al.

(10) Patent No.: US 9,807,537 B2
(45) Date of Patent: Oct. 31, 2017

(54) SIGNAL PROCESSOR AND SIGNAL PROCESSING METHOD

(71) Applicant: Yamaha Corporation, Hamamatsu-shi, Shizuoka (JP)

(72) Inventors: Yuta Yuyama, Hamamatsu (JP); Masaya Kano, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 12 days.

(21) Appl. No.: 14/970,032

(22) Filed: Dec. 15, 2015

(65) Prior Publication Data

US 2016/0174009 A1 Jun. 16, 2016

(30) Foreign Application Priority Data

Dec. 16, 2014 (JP) ..... 2014-254048

(51) Int. Cl.
*H04R 5/00* (2006.01)
*H04S 7/00* (2006.01)
(Continued)

(52) U.S. Cl.
CPC ..... *H04S 7/305* (2013.01); *H04R 3/04* (2013.01); *H04S 3/002* (2013.01);
(Continued)

(58) Field of Classification Search
CPC .. H04S 2400/03; H04S 2400/01; H04S 7/305; H04S 3/002; H04S 2400/07; H04S 2400/09; H04S 2400/11; H04S 2420/01; H04S 2420/05; H04S 2420/07; H04R 3/04; H04R 2430/03; H04R 5/02
See application file for complete search history.

(56) References Cited

U.S. PATENT DOCUMENTS

2005/0281408 A1 12/2005 Kim et al.
2011/0268299 A1 11/2011 Oda
(Continued)

FOREIGN PATENT DOCUMENTS

JP 2013-176170 A 9/2013

OTHER PUBLICATIONS

European Search Report issued in counterpart European Application No. 15200125.1 dated May 18, 2016 (eight pages).
(Continued)

*Primary Examiner* — Andrew L Sniezek
(74) *Attorney, Agent, or Firm* — Crowell & Moring LLP

(57) ABSTRACT

A signal processor includes an input unit that receives a first audio signal and a second audio signal including mutually correlated components, a delay unit that delays the first audio signal received at the input unit by a prescribed delay time, a synthesis unit that synthesizes the first audio signal having been delayed by the delay unit with the second audio signal received at the input unit, and outputs a third audio signal resulting from synthesis, and a frequency band restriction unit that restricts a level of the first audio signal before the synthesis in a prescribed frequency band including a frequency of a dip occurring at a lowest frequency among a plurality of dips occurring in a frequency characteristic of the third audio signal as a result of the synthesis performed by the synthesis unit.

10 Claims, 12 Drawing Sheets

(51) Int. Cl.
*H04R 3/04* (2006.01)
*H04S 3/00* (2006.01)

(52) U.S. Cl.
CPC ..... *H04R 2430/03* (2013.01); *H04S 2400/03* (2013.01); *H04S 2400/07* (2013.01); *H04S 2400/09* (2013.01); *H04S 2400/11* (2013.01); *H04S 2420/01* (2013.01); *H04S 2420/05* (2013.01); *H04S 2420/07* (2013.01)

(56) References Cited

U.S. PATENT DOCUMENTS

2012/0051565 A1 3/2012 Iwata
2012/0121092 A1* 5/2012 Starobin ..... H04R 5/02 381/17

OTHER PUBLICATIONS

Office Action issued in counterpart European Application No. 15 200 125.1 dated Aug. 4, 2017 (5 pages).

* cited by examiner

SIGNAL PROCESSOR AND SIGNAL PROCESSING METHOD

CROSS REFERENCE TO RELATED APPLICATIONS

This application is based on Japanese Patent Application (No. P2014-254048) filed on Dec. 16, 2014, the contents of which are incorporated herein by reference.

BACKGROUND OF THE INVENTION

1. Field of the Invention

The present disclosure relates to a signal processor that synthesizes two audio signals including mutually correlated components and outputs an audio signal resulting from the synthesis, and a signal processing method thereof.

2. Description of the Related Art

A signal processor that synthesizes two audio signals including mutually correlated components and outputs an audio signal resulting from the synthesis is conventionally known.

For example, a signal processor disclosed in JP-A-2013-176170 synthesizes a surround back audio signal having been subjected to prescribed sound processing and a surround side audio signal, and outputs a synthesized audio signal to a surround speaker. The surround back audio signal having been subjected to the prescribed sound processing and the surround side audio signal include mutually correlated components in some cases to generate a vertical sound.

Before synthesizing two audio signals including mutually correlated components, however, if one of the audio signals is delayed, dips occur in some frequency bands of the audio signal resulting from the synthesis. As a result, a listener feels insufficiency in a low frequency range owing to a dip occurring, for example, in a frequency band of 100 Hz or lower.

SUMMARY OF THE INVENTION

Therefore, an object of the present disclosure is to provide a signal processor and a signal processing method in which sound quality of an output signal resulting from synthesis of two audio signals including mutually correlated components is not affected even if one of the audio signals is delayed before the synthesis.

A signal processor of the present disclosure includes: an input unit configured to receive a first audio signal and a second audio signal including mutually correlated components; a delay unit configured to delay the first audio signal received at the input unit by a prescribed delay time; a synthesis unit configured to synthesize the first audio signal having been delayed by the delay unit with the second audio signal received at the input unit, and outputs a third audio signal resulting from synthesis; and a frequency band restriction unit configured to restrict a level of the first audio signal before the synthesis performed by the synthesis unit in a prescribed frequency band including a frequency of a dip occurring at a lowest frequency among a plurality of dips otherwise occurring in a frequency characteristic of the third audio signal as a result of the synthesis performed by the synthesis unit.

A signal processor of the present disclosure includes: an input unit configured to receive a first audio signal and a second audio signal including mutually correlated components; a delay unit configured to delay the first audio signal received at the input unit by a prescribed delay time; a synthesis unit configured to synthesize the first audio signal having been delayed by the delay unit with the second audio signal received at the input unit, and outputs a third audio signal resulting from synthesis; and an adjustment section configured to determine a dip occurring at a lowest frequency among a plurality of dips occurring in a frequency characteristic of the third audio signal as a result of the synthesis performed by the synthesis unit, and to adjust the prescribed delay time for changing the frequency of the determined dip or reducing an amount of the obtained dip.

A signal processing method includes: receiving at an input unit a first audio signal and a second audio signal including mutually correlated components; delaying the first audio signal received at the input unit by a prescribed delay time; synthesizing the first audio signal having been delayed in the delaying with the second audio signal received at the input unit, and outputs a third audio signal resulting from synthesis; and restricting a level of the first audio signal before the synthesis performed by the synthesizing in a prescribed frequency band including a frequency of a dip occurring at a lowest frequency among a plurality of dips otherwise occurring in a frequency characteristic of the third audio signal as a result of the synthesis performed by the synthesizing.

A signal processing method includes: receiving at an input unit a first audio signal and a second audio signal including mutually correlated components; delaying the first audio signal received at the input unit by a prescribed delay time; synthesizing the first audio signal having been delayed in the delaying with the second audio signal received at the input unit, and outputs a third audio signal resulting from synthesis; and determining a dip occurring at a lowest frequency among a plurality of dips occurring in a frequency characteristic of the third audio signal as a result of the synthesis performed by the synthesizing, and adjusting the prescribed delay time for changing the frequency of the determined dip or reducing an amount of the obtained dip.

The signal processor and the signal processing method of the present disclosure can prevent the sound quality of an output signal resulting from synthesis of two audio signals including mutually correlated components from being affected even if one of the audio signals is delayed before the synthesis.

DETAILED DESCRIPTION OF THE EXEMPLARY EMBODIMENTS

Figure 1:
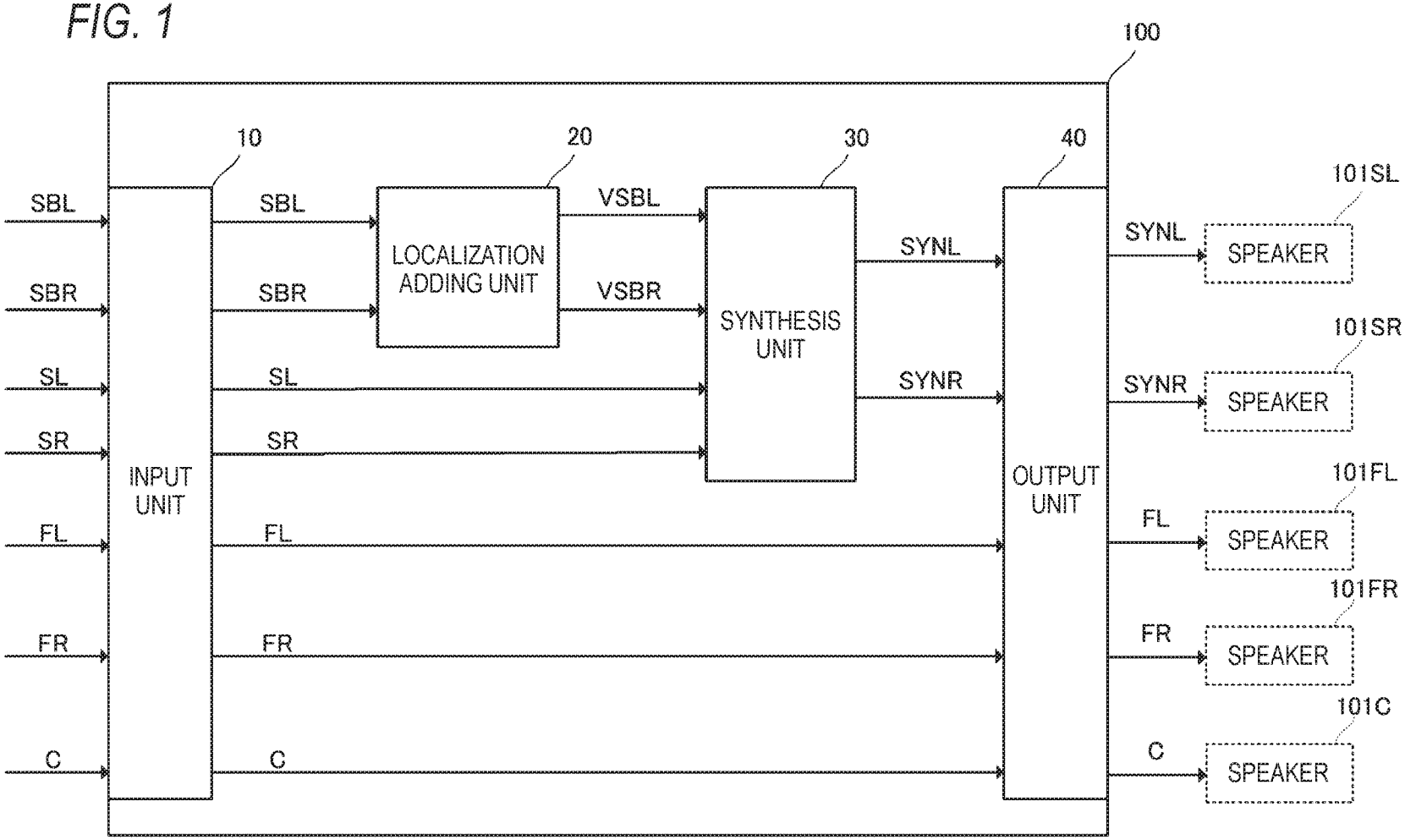
FIG. 1 is a functional block diagram of a signal processor according to Embodiment 1.
Figure 2:
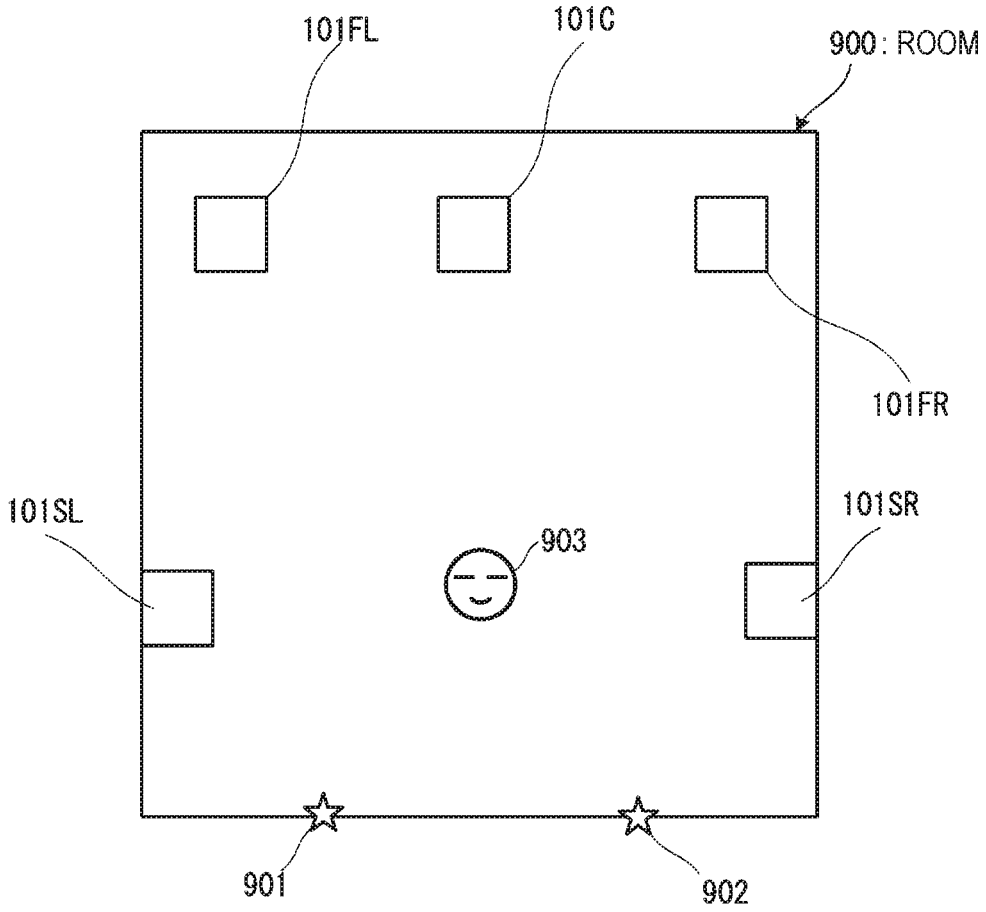
FIG. 2 is a plan schematic diagram illustrating arrangement of speakers connected to the signal processor of Embodiment 1.
Figure 3:
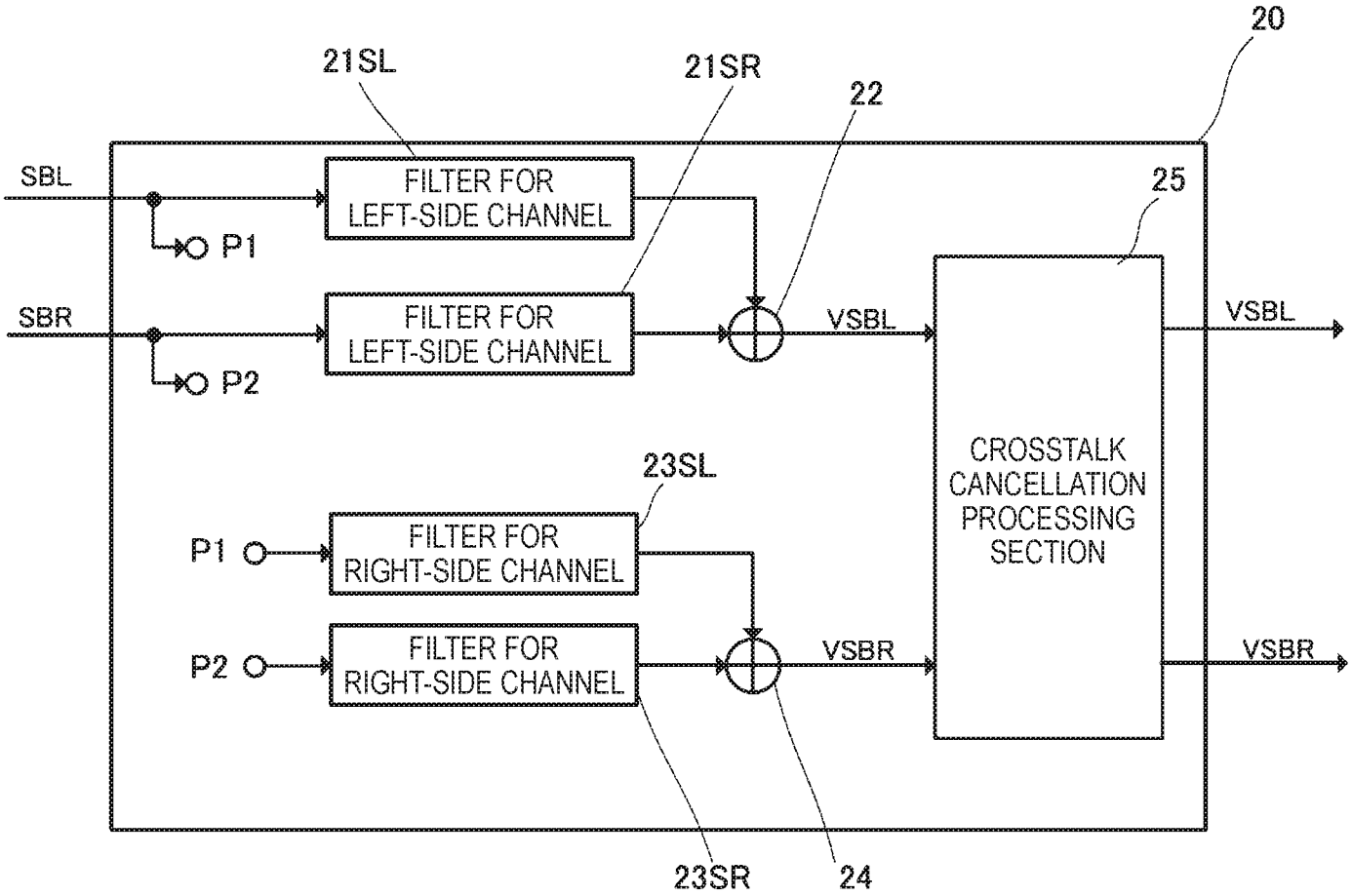
FIG. 3 is a functional block diagram of a localization adding unit of the signal processor of Embodiment 1.
Figure 4:
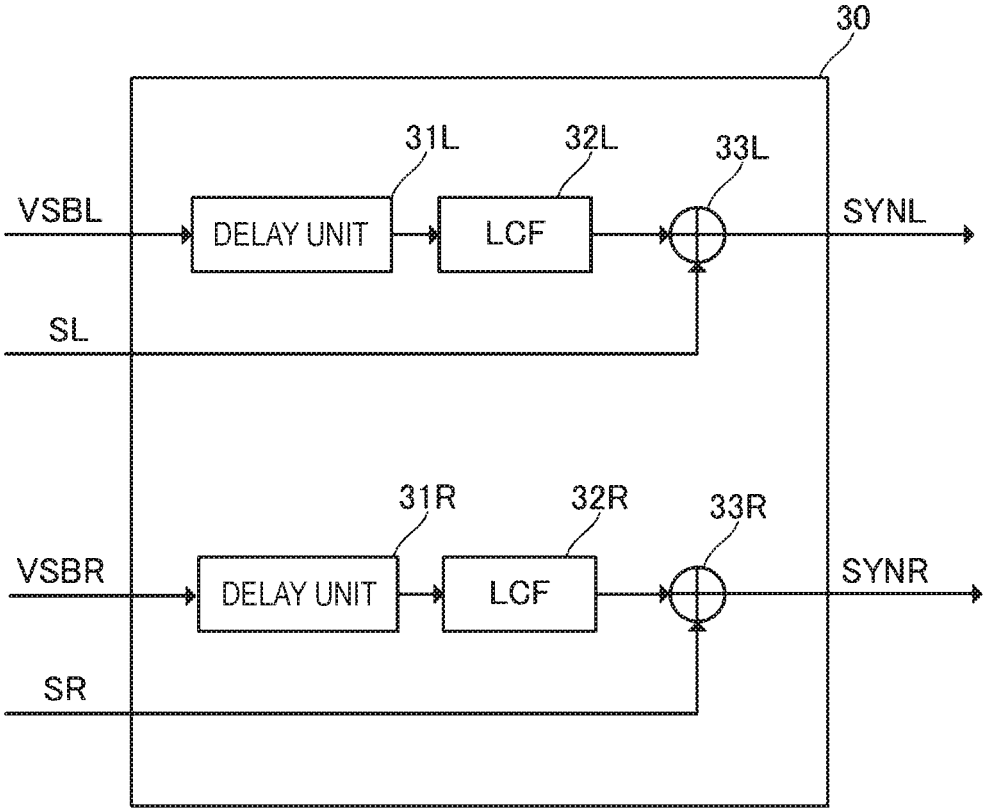
FIG. 4 is a functional block diagram of a synthesis unit of the signal processor of Embodiment 1.

A signal processor 100 according to Embodiment 1 will now be described with reference to FIGS. 1 to 4. FIG. 1 is a functional block diagram of the signal processor 100. FIG. 2 is a plan schematic diagram illustrating arrangement of speakers connected to the signal processor 100. FIG. 3 is a functional block diagram of a localization adding unit 20 of the signal processor 100. FIG. 4 is a functional block diagram of a synthesis unit 30 of the signal processor 100.

As for the outline of the signal processor 100, the signal processor 100 performs prescribed signal processing on audio signals of an FL channel, an FR channel, a C channel, an SL channel, an SR channel, an SBL channel and an SBR channel input thereto. In the present embodiment, the signal processor 100 generates, as the prescribed signal processing, an audio signal VSBL and an audio signal VSBR for localizing an audio signal SBL and an audio signal SBR of the SBL channel and the SBR channel as virtual sound sources. The generated audio signals VSBL and VSBR are delayed by a prescribed delay time and then respectively synthesized with an audio signal SL and an audio signal SR input to the signal processor 100. An audio signal SYNL and an audio signal SYNR resulting from the synthesis are respectively output to a speaker 101SL and a speaker 101SR. Specifically, the speaker 101SL emits a sound on the basis of the signal SYNL resulting from the synthesis of the audio signal SL and the audio signal VSBL. The speaker 101SR emits a sound on the basis of the signal SYNR resulting from the synthesis of the audio signal SR and the audio signal VSBR.

The signal processor 100 of the present embodiment suppresses insufficiency in a low frequency range caused after the synthesis of the audio signal VSBL delayed by a prescribed delay time and the audio signal SL. The signal processor 100 suppresses insufficiency in a low frequency range caused by the synthesis of the audio signal VSBR delayed by a prescribed delay time and the audio signal SR.

As illustrated in FIG. 1, the signal processor 100 is connected to five speakers 101FL, 101FR, 101C, 101SL and 101SR. The signal processor 100 includes an input unit 10, a localization adding unit 20, a synthesis unit 30 and an output unit 40.

As illustrated in FIG. 2, in a room 900, the speaker 101FL is disposed on a front left side of a listener 903, the speaker 101FR is disposed on a front right side of the listener 903, and the speaker 101C is disposed in front of the listener 903. The speaker 101SL is disposed on a left side of the listener 903, and the speaker 101SR is disposed on a right side of the listener 903.

To the input unit 10, respective audio signals of the seven channels (FL, FR, C, SL, SR, SBL and SBR) are input. The audio signals SBL and SBR input to the input unit 10 are respectively output to the localization adding unit 10. Incidentally, the input unit 10 may include an HDMI (High Definition Multimedia Interface (registered trademark)), so that the respective audio signals may be input thereto together with video signals. Besides, if analog audio signals are input, the input unit 10 performs A/D conversion to obtain digital sound signals.

The input unit 10 outputs the audio signal SL and the audio signal SR to the synthesis unit 30. The input unit 10 outputs the audio signal FL, the audio signal FR and the audio signal C to the output unit 40.

The localization adding unit 20 generates the audio signal VSBL and the audio signal VSBR for localizing the audio signal SBL and the audio signal SBR in the positions of virtual sound sources. In order to localize an audio signal in the position of a virtual sound source, a head-related transfer function (hereinafter referred to as the HRTF) corresponding to a transfer function between a prescribed position and an ear of a listener is used.

The HRTF is an impulse response representing the loudness, the arrival time, the frequency characteristic and the like of a sound that is emitted from a virtual speaker disposed in a given position and reaches each of the right and left ears. When a sound is emitted from the speaker 101SL (or the speaker 101SR) with an audio signal provided with the HRTF, a listener perceives as if the sound was emitted from a virtual speaker.

Specifically, the localization adding unit 20 includes, as illustrated in FIG. 3, filters 21SL and 21SR and filters 23SL and 23SR for convolving the HRTF impulse response for the respective channels. The localization adding unit 20 includes a synthesizer 22, a synthesizer 24, and a crosstalk cancellation processing section 25.

The audio signal SBL is input to the filter 21SL and the filter 23SL. The filter 21SL provides the audio signal SBL with an HRTF from the position of a virtual sound source 901 on a rear left side of the listener 903 (see FIG. 2) to the left ear. The filter 23SL provides the audio signal SBL with an HRTF from the position of the virtual sound source 901 to the right ear.

The filter 21SR provides the audio signal SBR with an HRTF from the position of a virtual sound source 902 on a rear right side of the listener (see FIG. 2) to the left ear of the listener 903. The filter 23SR provides the audio signal SBR with an HRTF from the position of the virtual sound source 902 to the right ear.

The synthesizer 22 synthesizes the audio signal SBL and the audio signal SBR respectively output from the filter 21SL and the filter 21SR, and outputs the audio signal VSBL resulting from the synthesis to the crosstalk cancellation processing section 25. The synthesizer 24 synthesizes the audio signals SBL and SBR respectively output from the filters 23SL and 23SR, and outputs the audio signal VSBR resulting from the synthesis to the crosstalk cancellation processing section 25.

The crosstalk cancellation processing section 25 performs, on the audio signal VSBL and the audio signal VSBR, processing for inhibiting a sound emitted from the speaker 101SL from being heard by the right ear by emitting, from the speaker 101SR, a component in a phase opposite to a crosstalk emitted from the speaker 101SL and reaching the right ear for canceling the sound pressure in the position of the right ear. The crosstalk cancellation processing section 25 performs, on the audio signal VSBL and the audio signal VSBR, processing for inhibiting a sound emitted from the speaker 101SR from being heard by the left ear by emitting, from the speaker 101SL, a component in a phase opposite to a crosstalk emitted from the speaker 101SR and reaching the left ear for canceling the sound pressure in the position of the left ear. If the signal processor 100 outputs a headphone audio signal, however, the crosstalk cancellation processing section 25 is not indispensable in the present embodiment.

The audio signal VSBL and the audio signal VSBR output from the crosstalk cancellation processing section 25 are respectively input to the synthesis unit 30 as illustrated in FIG. 1. As described above, the audio signal SL and the audio signal SR output from the input unit 10 are also input to the synthesis unit 30.

The synthesis unit 30 synthesizes the audio signal VSBL for localizing the virtual sound source and the audio signal SL to be output to the speaker 100SL. The synthesis unit 30 synthesizes the audio signal VSBR for localizing the virtual sound source and the audio signal SR to be output to the speaker 100SR.

Specifically, the synthesis unit 30 includes, as illustrated in FIG. 4, a delay unit 31L, an LCF (low cut filter) 32L, a synthesizer 33L, a delay unit 31R, an LCF 32R and a synthesizer 33R.

The audio signal VSBL, which has been provided with the HRTFs corresponding to the positions of the virtual sound source 901 and the virtual sound source 902 and has been subjected to the crosstalk cancellation processing, is input to the delay unit 31L. The delay unit 31L delays the input audio signal VSBL by a prescribed delay time.

The delay time set in the delay unit 31L is, for example, set to a value in a range from 1 ms to 30 ms. The delay time in the range from 1 ms to 30 ms corresponds to a time not causing an echo even if the delayed audio signal VSBL is synthesized with the audio signal SL. In other words, two sounds including the same component (namely, the delayed audio signal VSBL and the audio signal SL) are perceived as one sound by a listener even if these sounds reach the listener with a time shift of the delay time in the range of 1 ms to 30 ms. Accordingly, the delay time of the delay unit 31L corresponds to a time for allowing the audio signal VSBL and the audio signal SL to be perceived as one sound. Besides, this delay time is set to a range for causing a precedence effect (Haas effect).

The audio signal VSBR, which has been provided with the HRTFs corresponding to the positions of the virtual sound source 901 and the virtual sound source 902 and has been subjected to the crosstalk cancellation processing, is input to the delay unit 31R. The delay unit 31R delays the input audio signal VSBR by a prescribed delay time. In the delay unit 31R, the same delay time as that set in the delay unit 31L is set.

In the signal processor 100, since the audio signal VSBL and the audio signal VSBR are delayed before respectively synthesizing with the audio signal SL and the audio signal SR, the listener can more definitely feel the localization of the virtual sound source 901 and the virtual sound source 902.

Here, the audio signal SBL and the audio signal SL include mutually correlated components in some cases. Accordingly, the audio signal VSBL and the audio signal SL also include mutually correlated components in some cases. Similarly, the audio signal VSBR and the audio signal SR include mutually correlated components in some cases.

If two audio signals including correlated components are synthesized after delaying one of them, dips occur in some frequency bands of an audio signal resulting from the synthesis. Therefore, in the signal processor 100 of the present embodiment, in order to reduce the amount of at least a dip occurring at the lowest frequency among the plural dips, the levels in a prescribed low frequency range of the audio signal VSBL and the audio signal VSBR are restricted before synthesizing them with the audio signal SL and the audio signal SR.

Specifically, the audio signal VSBL output from the delay unit 31L is input to the LCF 32L. The LCF 32L restricts the level in the prescribed low frequency range of the input audio signal VSBL. The audio signal VSBL thus restricted in the low frequency range is output to the synthesizer 33L. Similarly, the audio signal VSBR output from the delay unit 31R is input to the LCF 32R. The LCF 32R restricts the level of the input audio signal VSBR in the same frequency band as the level restriction frequency band of the LCF 32L. The audio signal VSBR thus restricted in the low frequency range is output to the synthesizer 33R.

The level restriction frequency band of the LCF 32L is set to include the lowest frequency (of, for example, 40 Hz) among the frequencies of the plural dips occurring in the frequency characteristic as a result of the synthesis of the audio signals generated by the synthesizer 33L. For example, the level restriction frequency band of the LCF 32L and the LCF 32R is set to a range of 0 Hz to 500 Hz.

Besides, the level restriction frequency band of the LCF 32L and the LCF 32R is preferably set to a frequency band in a range not inhibiting the localization effect of the virtual sound sources. For example, the level restriction frequency band of the LCF 32L and the LCF 32R is set to a low frequency range of, for example, 1 kHz to 3 kHz because a listener more strongly feels localization feeling of a virtual sound source owing to this frequency band of 1 kHz to 3 kHz.

Besides, the level restriction frequency band of the LCF 32L and the LCF 32R is preferably set to a range (of, for example, 0 Hz to 100 Hz) for allowing a listener to easily feel voluminous feeling of the low frequency range.

Besides, if the signal processor 100 outputs a low frequency range of the speaker 101FL to a subwoofer, the upper limit frequency of the level restriction frequency band of the LCF 32L and the LCF 32R may be a cut-off frequency of the speaker 101FL.

The synthesizer 33L synthesizes the audio signal VSBL and the audio signal SL input thereto and outputs an audio signal resulting from the synthesis as the audio signal SYNL. The synthesizer 33R synthesizes the audio signal VSBR and the audio signal SR input thereto and outputs an audio signal resulting from the synthesis as the audio signal SYNR.

The audio signal SYNL and the audio signal SYNR output from the synthesis unit 30 are output to the output unit 40 as illustrated in FIG. 1. The output unit 40 D/A converts the audio signal SYNL and the audio signal SYNR input thereto, and amplifies analog audio signals resulting from the conversion. The audio signal SYNL and the audio signal SYNR resulting from the amplification are respectively output to the speaker 101SL and the speaker 101SR. The output unit 40 also performs the D/A conversion and the amplification of the audio signal FL, the audio signal FR and the audio signal C, and outputs the audio signal FL, audio signal C and audio signal FR resulting from the amplification respectively to the speaker 101FL, the speaker 101C and the speaker 101FR.

When sounds are emitted from the speaker 101SL and the speaker 101SR on the basis of the audio signal SYNL and the audio signal SYNR input thereto, the listener perceives that sound sources are present in the position of the speaker 101SL, the position of the speaker 101SR, the position of the virtual sound source 901 and the position of the virtual sound source 902.

Figure 5A:
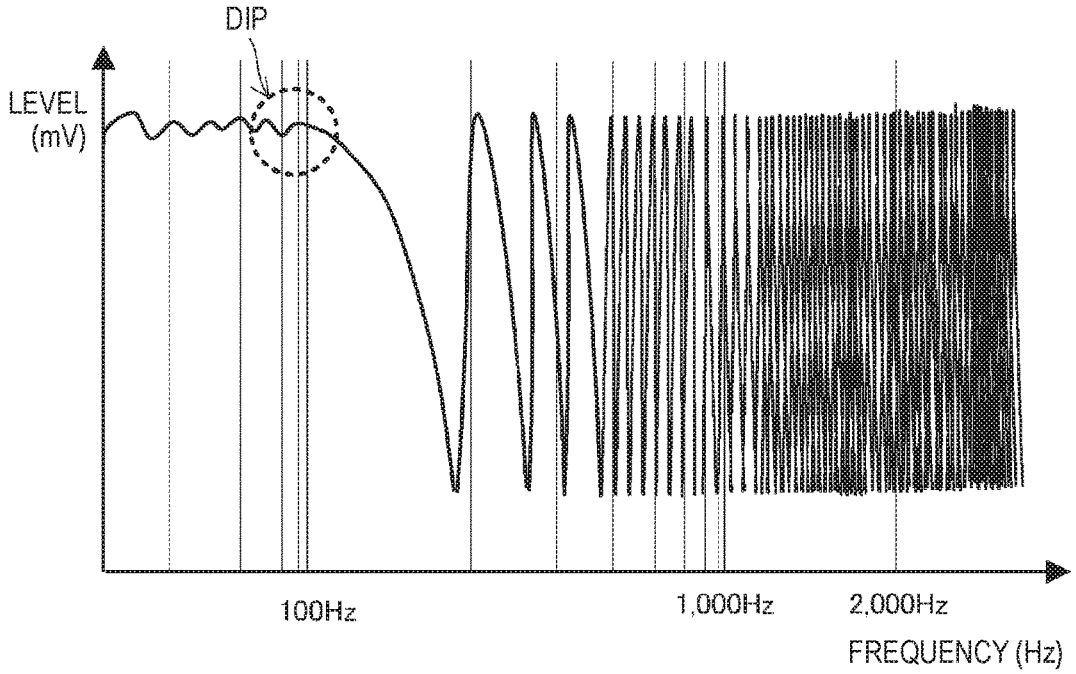
FIG. 5A is a schematic diagram illustrating a frequency characteristic of an audio signal synthesized by the signal processor of Embodiment 1.

Next, the effects attained by the signal processor 100 will be described with reference to FIGS. 5A and 5B. FIG. 5A is a schematic diagram illustrating a frequency characteristic of the audio signal SYNL synthesized in the signal processor 100, and FIG. 5B is a schematic diagram illustrating a frequency characteristic of an audio signal synthesized in a comparative example.

The frequency characteristic of the audio signal SYNL illustrated in FIG. 5A was obtained when the signal processor 100 of the present embodiment delayed, by 20 ms, the audio signal VSBL for allowing the virtual sound source 901 to be perceived, restricted the level in a range of 0 Hz to 100 Hz of the delayed audio signal VSBL, and synthesized the audio signal VSBL restricted in the level with the audio signal SL. For the description of the effects of the signal processor 100, however, the same audio signal was used as the audio signal VSBL before delaying and the audio signal SL.

The frequency characteristic of the comparative example was obtained under condition where the level in the range of 0 Hz to 100 Hz of the audio signal VSBL was not restricted, and the other conditions employed in the comparative example were the same as those employed for obtaining the frequency characteristic of FIG. 5A. Specifically, in the comparative example, one of the same two audio signals was delayed by 20 ms, and the delayed audio signal was synthesized with the other audio signal without restricting the level in the low frequency range of the delayed audio signal.

Figure 5B:
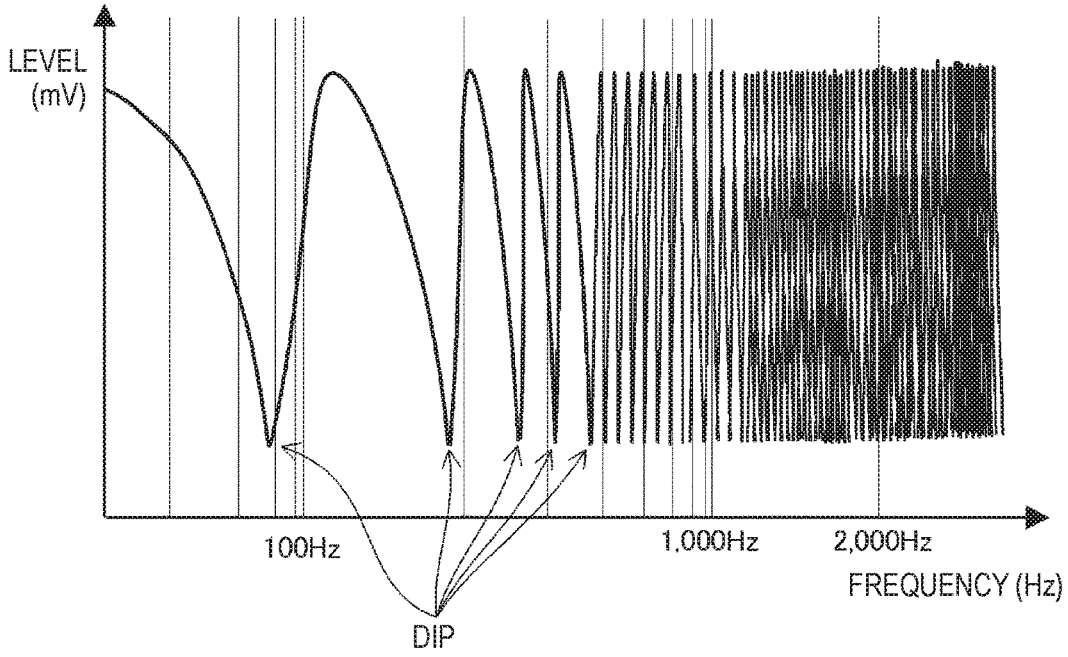
FIG. 5B is a schematic diagram illustrating a frequency characteristic of an audio signal synthesized in a comparative example.

As illustrated in FIG. 5B, since the audio signal before delaying and the delayed audio signal were synthesized in the comparative example, a dip corresponding to a drop in the level (dB) periodically occurred in the frequency characteristic of the audio signal resulting from the synthesis as in an output characteristic of a comb filter. In the present embodiment, however, a dip in the frequency characteristic of an audio signal resulting from synthesis refers to a portion where the level drops by a prescribed amount (of, for example, 10 dB) or more as a result of the synthesis as compared with that in frequency characteristics of two audio signals before the synthesis.

A listener feels the insufficiency in the low frequency range of the audio signal SL and the audio signal VSBL owing to a dip occurring at a low frequency. In the example illustrated in FIG. 5B, a listener feels the insufficiency in the low frequency range particularly owing to a dip occurring at about 40 Hz.

In the signal processor 100 according to the present embodiment, the level in the low frequency range of the delayed audio signal VSBL is restricted before synthesizing the two audio signals. In the example illustrated in FIG. 5A, since the level restriction frequency band of the LCF 32L and the LCF 32R is set to 0 Hz to 100 Hz, the signal processor 100 can reduce the amount of a dip occurring at about 40 Hz after the synthesis as illustrated in a region surrounded with a dotted line in FIG. 5A. As a result, a listener becomes difficult to feel the insufficiency in the low frequency range of the audio signal SL and the audio signal VSBL.

Besides, the signal processor 100 restricts the level of the delayed audio signal VSBL in the frequency band (0 Hz to 100 Hz) lower than the frequency band (of several kH) affecting to the localization effect for a virtual sound source. Accordingly, in the signal processor 100 of the present embodiment, even if the delayed audio signal VSBL and the audio signal SL are synthesized, the localization effect for a virtual sound source can be retained while suppressing the insufficiency in the low frequency range of the audio signal SL and the audio signal VSBL.

Similarly, in the signal processor 100 of the present embodiment, even if the delayed audio signal VSBR and the audio signal SR are synthesized, the localization effect for a virtual sound source can be retained while suppressing the insufficiency in the low frequency range of the audio signal SR and the audio signal VSBR.

Incidentally, in the signal processor 100, the level restriction frequency band of the LCF 32L and the LCF 32R can be set to 0 Hz to 200 Hz so that not only the dip occurring at about 40 Hz but also all dips occurring at 200 Hz or less can be reduced. Also in this case, the signal processor 100 can retain the localization effect for a virtual sound source.

Besides, although the audio signal VSBL and the audio signal VSBR for allowing the virtual sound sources to be perceived and the audio signal SL and the audio signal SR are respectively synthesized in the above-described example, the signal processor 100 can suppress the insufficiency in the low frequency range in a combination of other channels. For example, if the speaker 101SL and the speaker 101SR are not connected to the signal processor 100, when an audio signal for virtually localizing the audio signal SL is synthesized with the audio signal FL and an audio signal resulting from the synthesis is output to the speaker 101FL, the signal processor 100 can retain the effect of virtually localizing the audio signal SL of the SL channel while suppressing the insufficiency in the low frequency range.

It is noted that the delay unit 31L and the LCF 32L may be reversely disposed. Similarly, the delay unit 31R and the LCF 32R may be reversely disposed.

Figure 6:
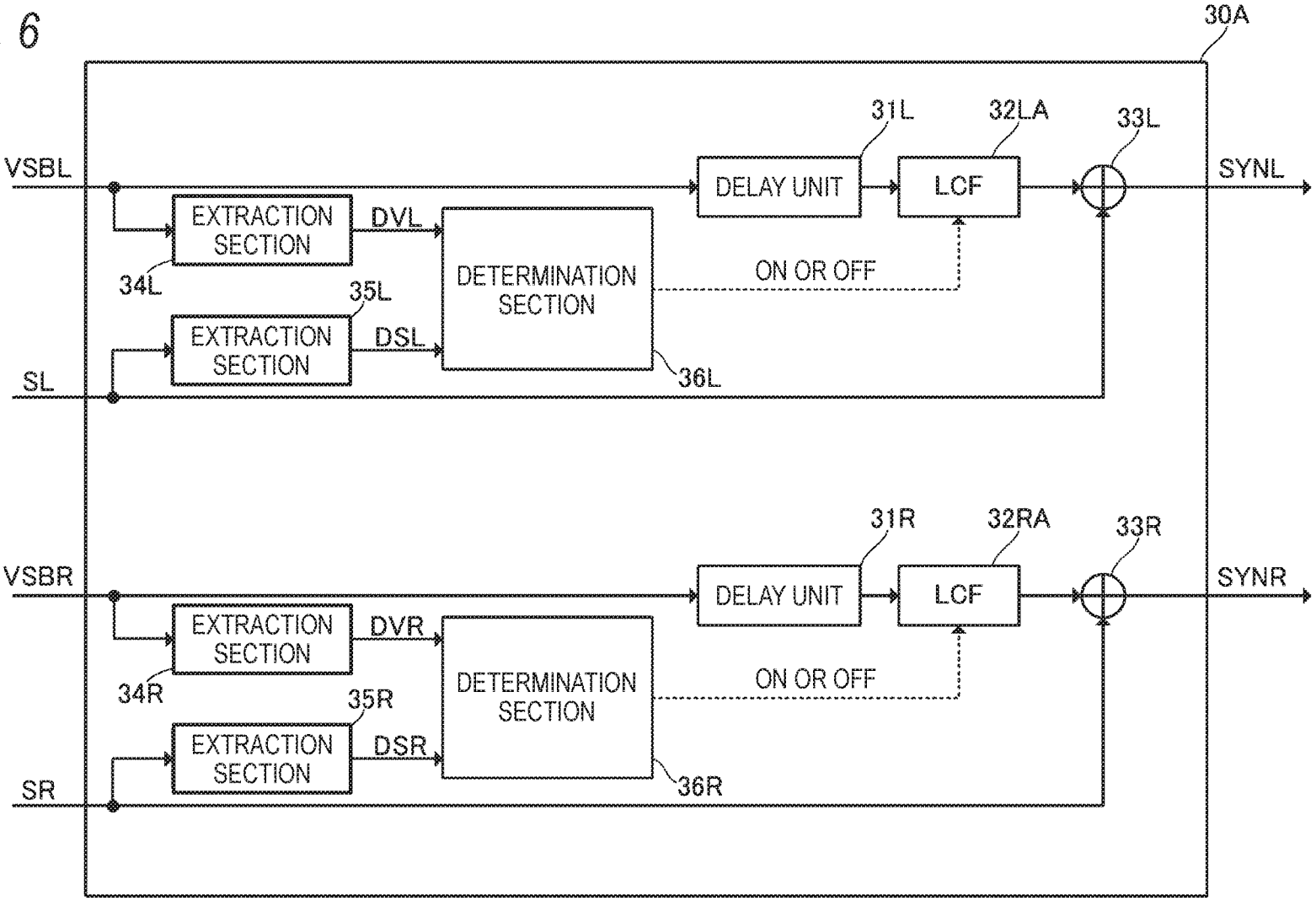
FIG. 6 is a functional block diagram of a synthesis unit according to Modification 1 of the synthesis unit of Embodiment 1.

Next, a synthesis unit 30A according to Modification 1 of the synthesis unit 30 will be described with reference to FIG. 6. FIG. 6 is a functional block diagram illustrating the configuration of the synthesis unit 30A. It is noted that a solid line corresponds to a flow of an audio signal and a dotted line corresponds to a control signal in FIG. 6.

The synthesis unit 30A controls the frequency band restricting function of an LCF 32LA to be turned on/off in accordance with the level in a low frequency range of the audio signal VSBL and the level in a low frequency range of the audio signal SL, and controls the frequency band restricting function of an LCF 32RA to be turned on/off in accordance with the level in a low frequency range of the audio signal VSBR and the level in a low frequency range of the audio signal SR.

Specifically, the synthesis unit 30A is different from the synthesis unit 30 in a point that it includes an extraction section 34L, an extraction section 35L, a determination section 36L, the LCF 32LA, an extraction section 34R, an extraction section 35R, a determination section 36R and the LCF 32RA.

The extraction section 34L is, for example, a low pass filter, and extracts a prescribed low frequency range (of, for example, 0 Hz to 100 Hz) from the audio signal VSBL input to the synthesis unit 30A and outputs an audio signal DVL resulting from the extraction to the determination section 36L. The extraction section 35L is, for example, a low pass filter, and extracts a prescribed low frequency range (of, for example, 0 Hz to 100 Hz) from the audio signal SL input to the synthesis unit 30A and outputs an audio signal DSL resulting from the extraction to the determination section 36L.

The determination section 36L turns on/off the frequency band restricting function of the LCF 32LA on the basis of the levels of the audio signal DVL and the audio signal DSL input thereto. Specifically, the determination section 36L turns on the frequency band restricting function of the LCF 32LA if the levels of both the audio signal DVL and the audio signal DSL are equal to or higher than a prescribed threshold value. In other words, the determination section 36L turns off the frequency band restricting function of the LCF 32LA if either one of the audio signals DVL and DSL is lower than the prescribed threshold value. Specifically, in a case where the level of either one of the audio signal VSBL and the audio signal SL is low in the range of 0 Hz to 100 Hz, even if the audio signal VSBL and the audio signal SL are synthesized, the amount of a dip occurring in the range of 0 Hz to 100 Hz is small, and therefore, the synthesis unit 30A synthesizes the audio signal VSBL and the audio signal SL without reducing a low frequency component of the audio signal VSBL by the LCF 32LA.

Similarly, the determination section 36R turns on/off the frequency band restricting function of the LCF 32RA on the basis of the level in the low frequency range of the audio signal DVR extracted by the extraction section 34R and the level in the low frequency range of the audio signal DSR extracted by the extraction section 35R. Accordingly, in a case where the level of either one of the audio signal VSBR and the audio signal SR is low in the range of 0 Hz to 100 Hz, the synthesis unit 30A synthesizes the audio signal VSBR and the audio signal SR without reducing a low frequency component of the audio signal VSBR by the LCF 32RA.

Figure 7:
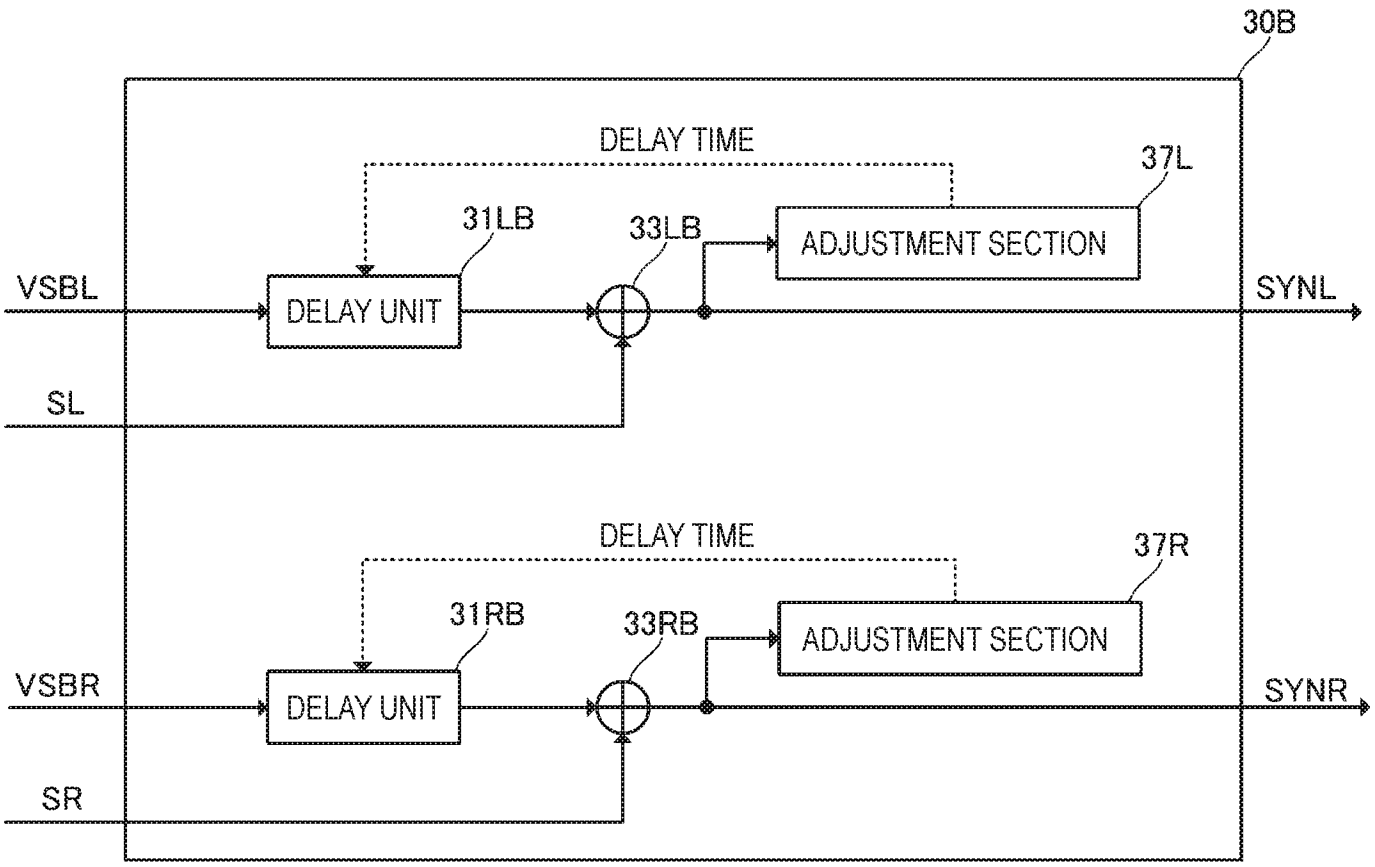
FIG. 7 is a functional block diagram of a synthesis unit according to Modification 2 of the synthesis unit of Embodiment 1.

Next, a synthesis unit 30B according to Modification 2 of the synthesis unit 30 will be described with reference to FIG. 7. FIG. 7 is a functional block diagram illustrating the configuration of the synthesis unit 30B.

The synthesis unit 30 and the synthesis unit 30A make a listener difficult to feel the insufficiency in the low frequency range by reducing the amount of a dip, but the synthesis unit 30B makes a listener difficult to feel the insufficiency in the low frequency range by changing the frequency and the amount of a dip.

Specifically, the synthesis unit 30B is different from the synthesis unit 30 in a point that it includes a delay unit 31LB, a synthesizer 33LB, an adjustment section 37L, a delay unit 31RB, a synthesizer 33RB and an adjustment section 37R.

The delay unit 31LB delays the audio signal VSBL input thereto on the basis of control information including a delay time. The control information including a delay time is output from the adjustment section 37L. The audio signal VSBL delayed by the delay unit 31LB is input to the synthesizer 33LB. The synthesizer 33LB synthesizes the delayed audio signal VSBL and the audio signal SL, and outputs an audio signal SYNL resulting from the synthesis. The audio signal SYNL is output also to the adjustment section 37L.

The adjustment section 37L obtains a frequency characteristic of the audio signal SYNL by, for example, performing Fourier transform on the audio signal SYNL. The adjustment section 37L obtains frequencies of a plurality of dips based on the obtained frequency characteristic. For example, since dips are present at frequencies where the frequency characteristic is at a prescribed level (dB) or lower, the adjustment section 37L obtains the plural frequencies of the prescribed level or lower. The adjustment section 37L specifies the lowest frequency among the obtained plural frequencies.

If the adjustment section 37L changes a delay time of the delay unit 31LB by outputting the control information including the delay time, the frequency characteristic of the audio signal SYNL is changed. In other words, the frequency and the amount of each dip in the frequency characteristic of the audio signal SYNL are changed again. The adjustment section 37L changes, through feedback control, the frequency and the amount of the dip occurring at the lowest frequency among the dips occurring in the frequency characteristic of the audio signal SYNL.

Similarly, the adjustment section 37R feedback controls the frequency and the amount of a dip occurring in the audio signal SYNR by changing a delay time of the delay unit 31RB. Thus, the frequency and the amount of the dip occurring in the audio signal SYNR are changed.

Figure 8:
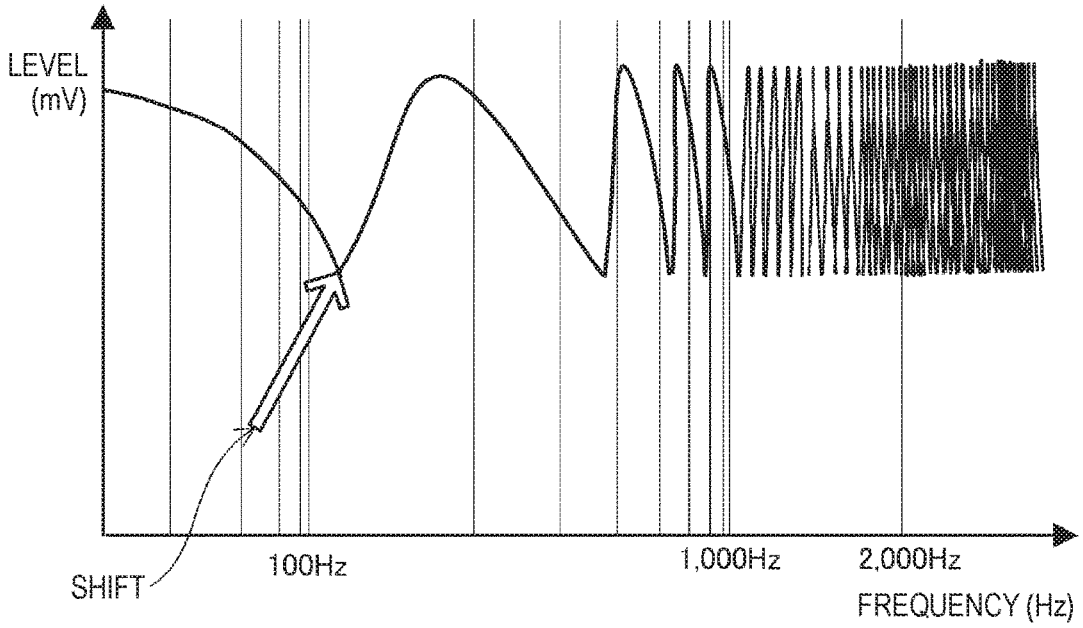
FIG. 8 is a schematic diagram illustrating a frequency characteristic of an audio signal synthesized by the synthesis unit of Modification 2.

The effects attained by the synthesis unit 30B will be described with reference to FIG. 8. FIG. 8 is a schematic diagram illustrating the frequency characteristic of the audio signal SYNL synthesized by the synthesis unit 30B.

When the frequency characteristic illustrated in FIG. 8 is compared with the frequency characteristic of the comparative example illustrated in FIG. 5B, the dip occurring at about 40 Hz is shifted to a frequency of 100 Hz or more and its amount is reduced. Since a listener easily feels volume insufficiency in a low frequency range owing to a dip occurring in a frequency band of 100 Hz or lower, the insufficiency in the low frequency range derived from the dip occurring about 40 Hz is thus made to be difficult to feel.

Figure 9:
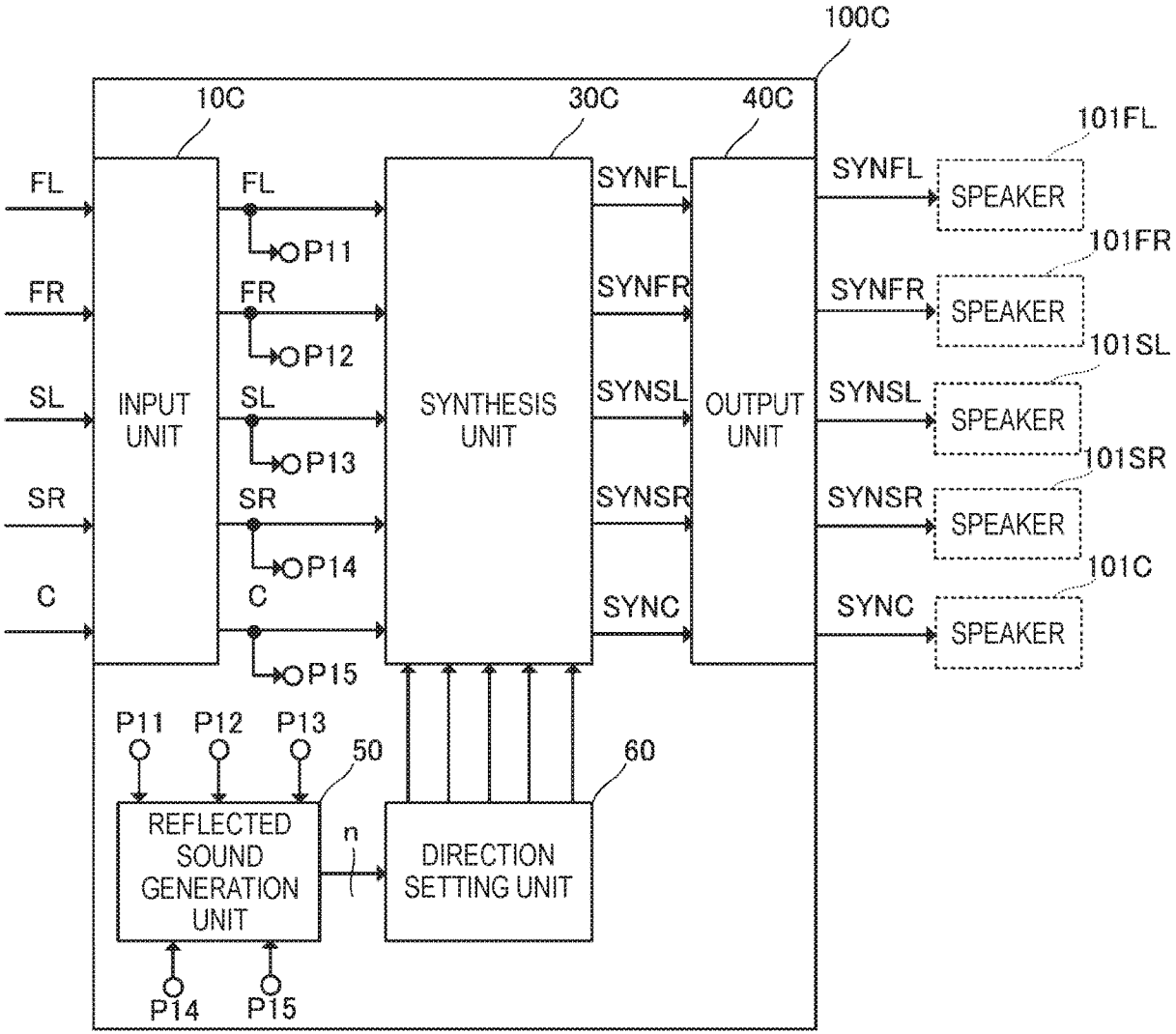
FIG. 9 is a functional block diagram of a signal processor according to Embodiment 2.
Figure 10A:
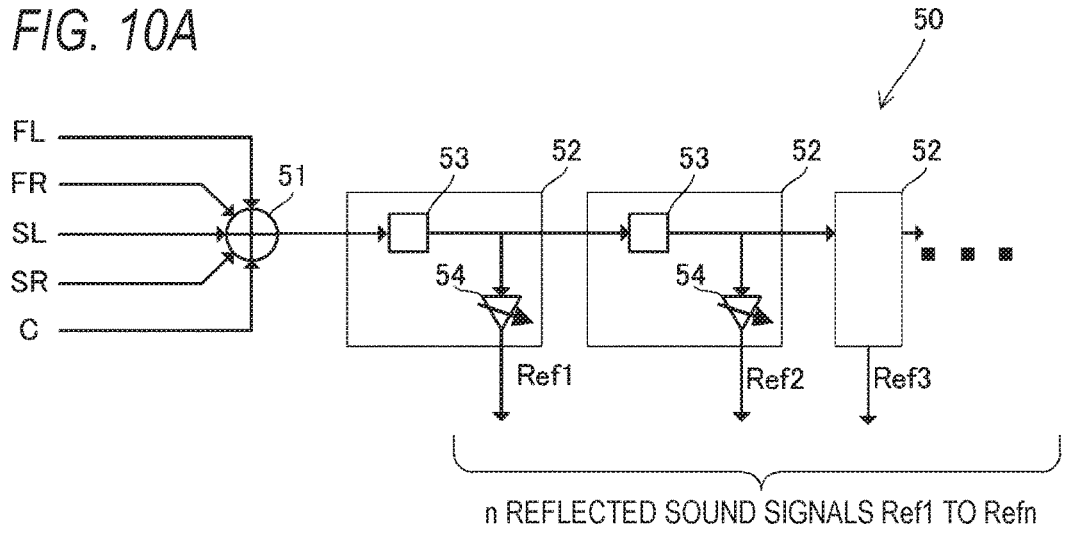
FIG. 10A is a functional block diagram of a reflected sound generation unit.
Figure 10B:
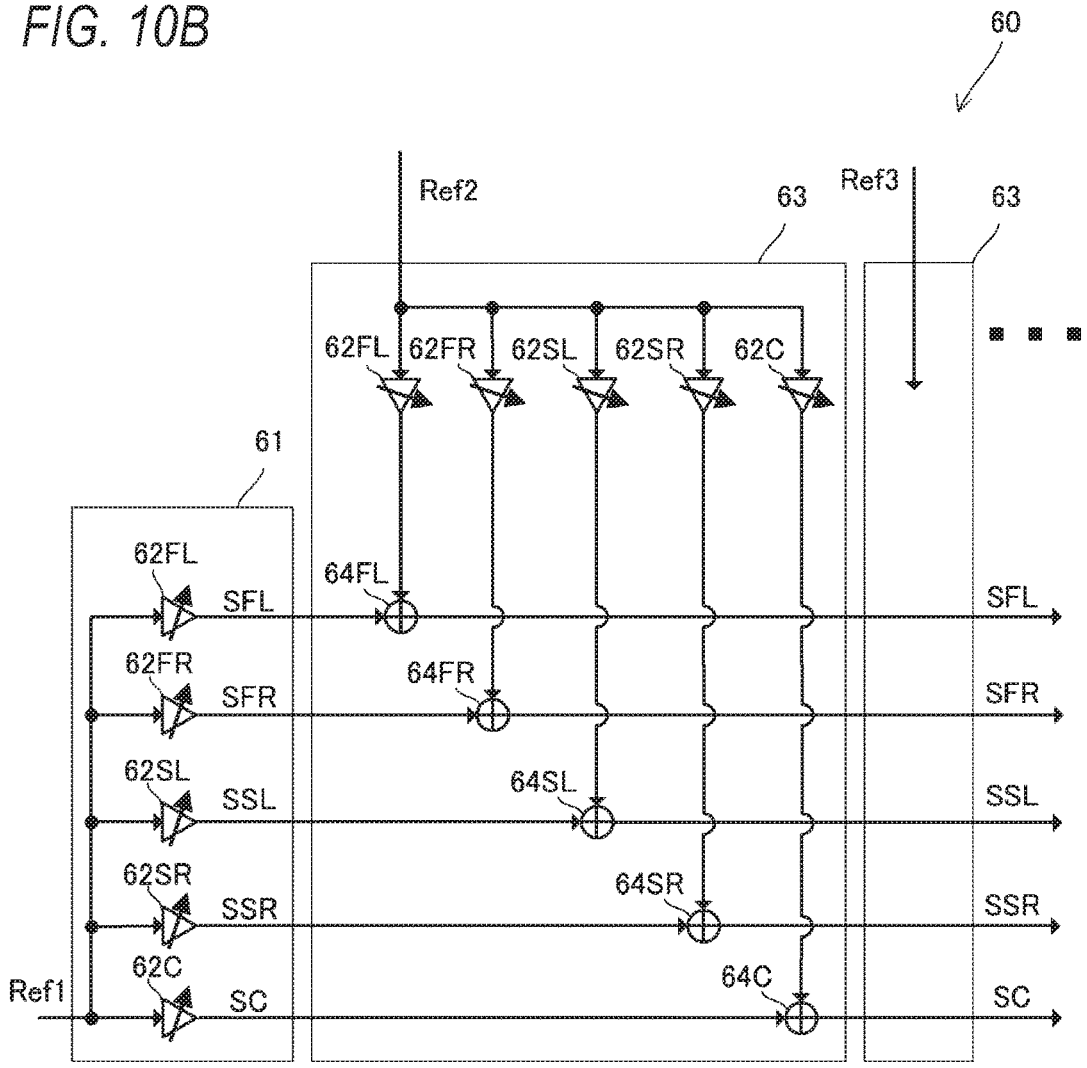
FIG. 10B is a functional block diagram of a direction setting unit.
Figure 11:
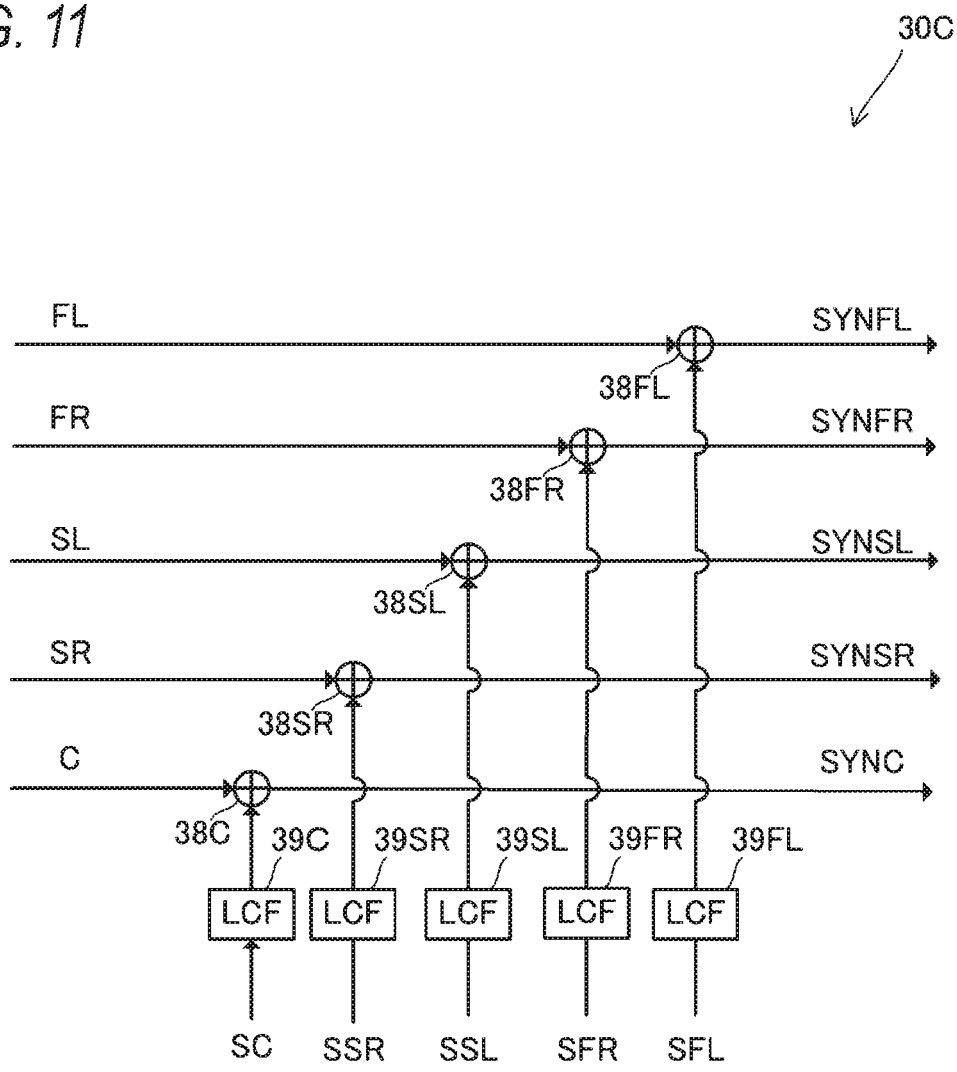
FIG. 11 is a functional block diagram of a synthesis unit of the signal processor of Embodiment 2.

Next, a signal processor 100C according to Embodiment 2 will be described with reference to FIG. 9, FIG. 10A, FIG. 10B and FIG. 11. FIG. 9 is a functional block diagram illustrating the configuration of the signal processor 100C. FIG. 10A is a functional block diagram illustrating the configuration of a reflected sound generation unit 50, and FIG. 10B is a functional block diagram illustrating the configuration of a direction setting unit 60. FIG. 11 is a functional block diagram illustrating the configuration of a synthesis unit 30C.

Although the signal processor 100 described above synthesizes an audio signal for allowing a virtual sound source to be perceived with an audio signal of an actual speaker channel, the signal processor 100C of the present embodiment synthesizes an audio signal simulating a reflected sound with an audio signal of each channel, so as to provide an audio signal input thereto with a sound field effect.

The sound field effect refers to an effect by which a listener can be allowed to have a sense of reality as if he/she was in another space such as an actual concert hall even though he/she is in his/her own room by outputting a simulated reflected sound simulating a reflected sound generated in an acoustic space such as a concert hall.

Specifically, the signal processor 100C includes, as illustrated in FIG. 9, an input unit 10C, the synthesis unit 30C, an output unit 40C, the reflected sound generation unit 50 and the direction setting unit 60. The signal processor 100C is connected to a speaker 101FL, a speaker 101FR, a speaker 101SL, a speaker 101SR and a speaker 101C.

The input unit 10C and the output unit 40C are different from the input unit 10 and the output unit 40 of Embodiment 1 in a point that audio signals of five channels (FL, FR, SL, SR and C) are input thereto.

To the reflected sound generation unit 50, an audio signal FL, an audio signal FR, an audio signal SL, an audio signal SR and an audio signal C output from the input unit 10C are input. The reflected sound generation unit 50 generates an audio signal of a simulated reflected sound by using the audio signals input thereto.

Specifically, the reflected sound generation unit 50 includes, as illustrated in FIG. 10A, a synthesizer 51 and a plurality of serially connected taps 52. The synthesizer 51 synthesizes the audio signals of the FL channel, the FR channel, the C channel, the SL channel and the SR channel input to the reflected sound generation unit 50 and outputs an audio signal resulting from the synthesis to the tap 52 disposed at the first stage.

Each tap 52 includes a delay device 53 and a level adjustment section 54. The delay device 53 delays an audio signal input thereto by a prescribed delay amount (of, for example, 1/fs second; in which fs indicates a sampling frequency). The delayed audio signal is output to the level adjustment section 54 and the delay device 53 of the tap 52 disposed at the next stage. The level adjustment section 54 adjusts the level of the audio signal input thereto, and outputs the audio signal having been adjusted in the level as a reflected sound signal Ref1.

The delay amount of the delay device 53 of each tap 52 is set on the basis of the sampling frequency of the audio signal. This delay time corresponds to a time difference between a direct sound directly reaching a listener from a speaker and a reflected sound reaching, from the speaker, the listener after reflecting on a wall, a ceiling or the like. A gain of the level adjustment section 54 of each tap 52 is set on the basis of a level ratio between the direct sound and a simulated reflected sound. As a result, the reflected sound signal Ref1 can be an audio signal simulating the delay time and the level of a first reflected sound.

The tap 52 disposed at the next stage outputs a reflected sound signal Ref2 simulating the delay time and the level of a second reflected sound. Similarly, each of the taps 52 disposed at the third and following stages outputs a corresponding reflected sound signal.

The reflected sound generation unit 50 generates n reflected sound signals by using the n taps 52, and outputs the generated reflected sound signals to the direction setting unit 60.

The direction setting unit 60 sets an arrival direction of each reflected sound signal. The arrival direction is set by distributing each reflected sound signal input thereto to the respective channels at a prescribed gain ratio. For example, if a reflected sound signal is distributed to the FL channel and the FR channel at a gain ratio of 1:1, the reflected sound signal is localized in a direction, based on a listening position, corresponding to the middle between the speaker 101FL and the speaker 101FR Specifically, the direction setting unit 60 includes, as illustrated in FIG. 10B, a distribution section 61 and a plurality of serially connected distribution sections 63. The distribution section 61 includes a level adjustment section 62FL, a level adjustment section 62FR, a level adjustment section 62SL, a level adjustment section 62SR and a level adjustment section 62C. To the level adjustment section 62FL, the level adjustment section 62FR, the level adjustment section 62SL, the level adjustment section 62SR and the level adjustment section 62C of the distribution section 61, the reflected sound signal Ref1 output from the reflected sound generation unit 50 is input. A gain of the level adjustment section 62FL, the level adjustment section 62FR, the level adjustment section 62SL, the level adjustment section 62SR and the level adjustment section 62C of the distribution section 61 is set on the basis of an arrival direction, to the listening position, of the reflected sound corresponding to the reflected sound signal Ref1. As a result, when the respective speakers emit sounds on the basis of the audio signal SFL, the audio signal SFR, the audio signal SSL, the audio signal SSR and the audio signal SC having been adjusted in the gain, the reflected sound signal Ref1 is localized in the arrival direction of the first reflected sound.

The distribution section 61 outputs the audio signal SFL, the audio signal SFR, the audio signal SSL, the audio signal SSR and the audio signal SC having been adjusted in the gain to the distribution section 63 disposed at the second stage.

Each distribution section 63 includes, in addition to the level adjustment section 62FL, the level adjustment section 62FR, the level adjustment section 62SL, the level adjustment section 62SR and the level adjustment section 62C, a synthesizer 64FL, a synthesizer 64FR, a synthesizer 64SL, a synthesizer 64SR and a synthesizer 64C.

To the level adjustment section 62FL, the level adjustment section 62FR, the level adjustment section 62SL, the level adjustment section 62SR and the level adjustment section 62C of the distribution section 63 disposed at the second stage, the reflected sound signal Ref2 is input. A gain of the level adjustment section 62FL, the level adjustment section 62FR, the level adjustment section 62SL, the level adjustment section 62SR and the level adjustment section 62C of the distribution section 63 disposed at the second stage is adjusted on the basis of an arrival direction of the second reflected sound.

Audio signals distributed by the level adjustment section 62FL, the level adjustment section 62FR, the level adjustment section 62SL, the level adjustment section 62SR and the level adjustment section 62C of the distribution section 63 disposed at the second stage are respectively input to the synthesizer 64FL, the synthesizer 64FR, the synthesizer 64SL, the synthesizer 64SR and the synthesizer 64C. The synthesizer 64FL, the synthesizer 64FR, the synthesizer 64SL, the synthesizer 64SR and the synthesizer 64C respectively synthesize, for the respective channels, the audio signal SFL, the audio signal SFR, the audio signal SSL, the audio signal SSR and the audio signal SC output from the distribution section 61 respectively with the audio signals output from the level adjustment section 62FL, the level adjustment section 62FR, the level adjustment section 62SL, the level adjustment section 62SR and the level adjustment section 62C of the distribution section 63 disposed at the second stage.

Similarly, the distribution section 63 disposed at the third stage distributes the reflected sound signal Ref3 to the respective channels, and synthesizes distributed audio signals respectively with the audio signal SFL, the audio signal SFR, the audio signal SSL, the audio signal SSR and the audio signal SC output from the distribution section 63 disposed at the second stage.

As a result of this, the audio signal SFL, the audio signal SFR, the audio signal SSL, the audio signal SSR and the audio signal SC output from the direction setting unit 60 respectively include components corresponding to the delay times, the levels and the arrival directions of the n reflected sounds.

The synthesis unit 30C synthesizes, for the respective channels, the audio signal SFL, the audio signal SFR, the audio signal SSL, the audio signal SSR and the audio signal SC output from the direction setting unit 60 respectively with the audio signal FL, the audio signal FR, the audio signal SL, the audio signal SR and the audio signal C output from the input unit 10C.

Specifically, the synthesis unit 30C includes, as illustrated in FIG. 11, a synthesizer 38FL, a synthesizer 38FR, a synthesizer 38SL, a synthesizer 38SR and a synthesizer 38C, and an LCF 39FL, an LCF 39FR, an LCF 39SL, an LCF 39SR and an LCF 39C.

The LCF 39FL, the LCF 39FR, the LCF 39SL, the LCF 39SR and the LCF 39C respectively restrict the level in the low frequency range of the audio signal SFL, the audio signal SFR, the audio signal SSL, the audio signal SSR and the audio signal SC output from the direction setting unit 60, and outputs the audio signal SFL, the audio signal SFR, the audio signal SSL, the audio signal SSR and the audio signal SC resulting from the level restriction respectively to the synthesizer 38FL, the synthesizer 38FR, the synthesizer 38SL, the synthesizer 38SR and the synthesizer 38C.

The synthesizer 38FL, the synthesizer 38FR, the synthesizer 38SL, the synthesizer 38SR and the synthesizer 38C respectively synthesize, for the respective channels, the audio signal FL, the audio signal FR, the audio signal SL, the audio signal SR and the audio signal C respectively with the audio signal SFL, the audio signal SFR, the audio signal SSL, the audio signal SSR and the audio signal SC, and outputs an audio signal SYNFL, an audio signal SYNFR, an audio signal SYNSL, an audio signal SYNSR and an audio signal SYNC resulting from the synthesis. Sounds respectively corresponding to the audio signal SYNFL, the audio signal SYNFR, the audio signal SYNSL, the audio signal SYNSR and the audio signal SYNC are output, via the output unit 40C, respectively from the speaker 101FL, the speaker 101FR, the speaker 101SL, the speaker 101SR and the speaker 101C. In other words, n simulated reflected sounds are output.

The signal processor 100C restricts the level in the low frequency range of the audio signal SFL, the audio signal SFR, the audio signal SSL, the audio signal SSR and the audio signal SC simulating the reflected sounds, and synthesizes, for the respective channels, the audio signal SFL, the audio signal SFR, the audio signal SSL, the audio signal SSR and the audio signal SC restricted in the level in the low frequency range respectively with the audio signal FL, the audio signal FR, the audio signal SL, the audio signal SR and the audio signal C, and therefore, the amount of a dip occurring in the low frequency range can be reduced.

The signal processor 100C may perform feedback control as that of the synthesis unit 30B illustrated in FIG. 7 for changing the frequency and the amount of a dip occurring at the lowest frequency so as to make the insufficiency in the low frequency range difficult to perceive.

Figure 12:
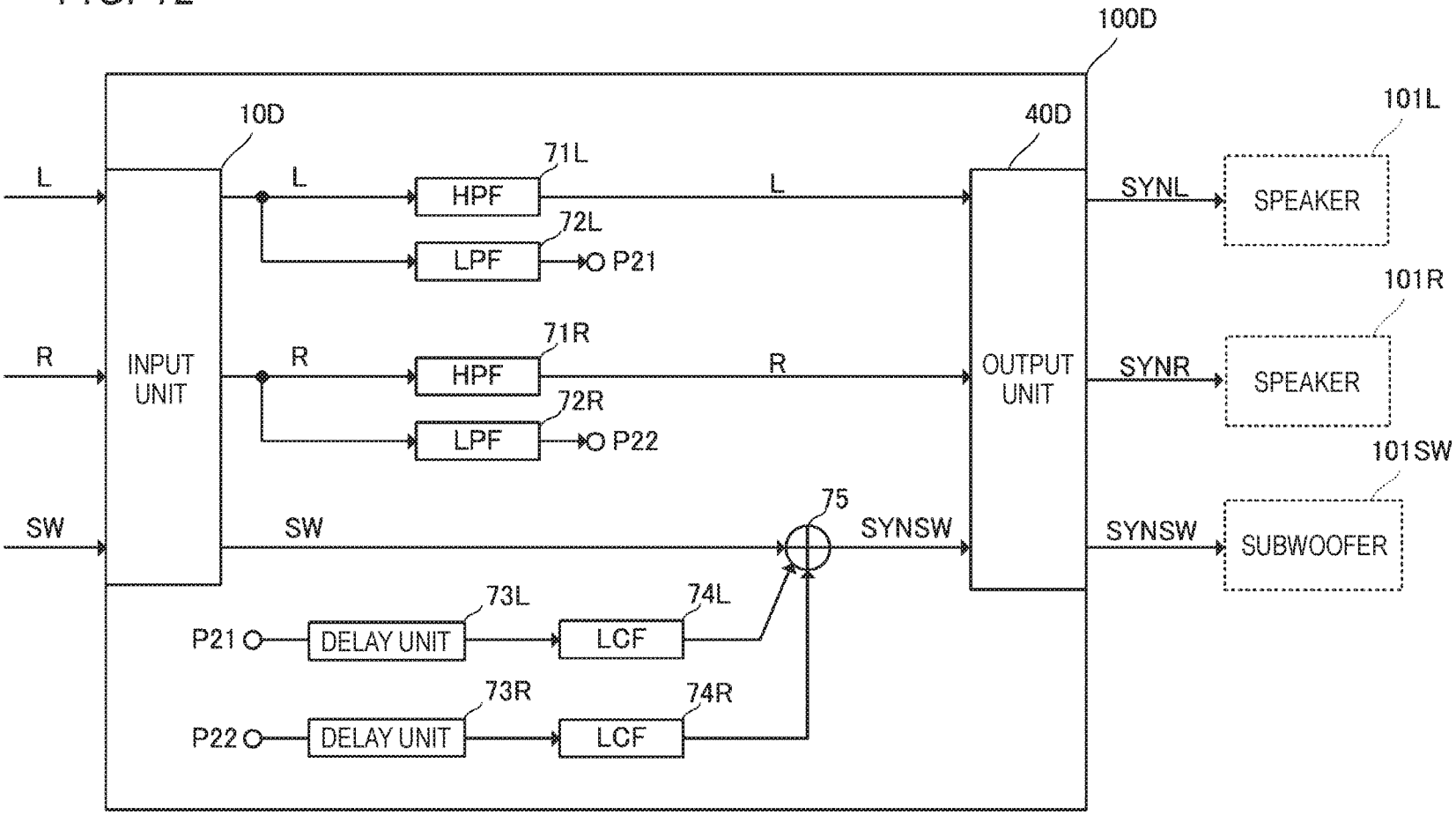
FIG. 12 is a functional block diagram of a signal processor according to Embodiment 3.

Next, a signal processor 100D according to Embodiment 3 will be described with reference to FIG. 12. In the signal processor 100D, low frequency components of audio signals L and R of stereo channels are respectively delayed before being synthesized with an audio signal SW of a subwoofer channel.

Specifically, the signal processor 100D is connected to a speaker 101L, a speaker 101R and a subwoofer 101SW. The signal processor 100D includes an input unit 10D, an output unit 40D, an HPF (high pass filter) 71L, an HPF 71R, an LPF (low pass filter) 72L, an LPF 72R, a delay unit 73L, a delay unit 73R, an LCF 74L, an LCF 74R and a synthesis unit 75.

The input unit 10D and the output unit 40D are different from the input unit 10 and the output unit 40 of Embodiment 1 in a point that the number of channels of audio signals input thereto is different.

A high frequency component (of, for example, 500 Hz or higher) of the audio signal L of the L channel output from the input unit 10D is output to the output unit 40D by the HPF 71L. A low frequency component (lower than 500 Hz) of the audio signal L of the L channel output from the input unit 10D is output to the delay unit 73L by the LPF 72L. The delay unit 73L delays the low frequency component of the audio signal L by a delay time of, for example, 1 ms to 30 ms in order to increase a low frequency component of a sound output from the subwoofer 101SW. The delay unit 73L outputs the delayed audio signal to the LCF 74L. The LCF 74L restricts the level in a range of 0 Hz to 100 Hz of the audio signal input thereto, and outputs the audio signal resulting from the level restriction to the synthesis unit 75.

Similarly, a high frequency component of the audio signal R of the R channel output from the input unit 10D is output via the HPF 71R to the output unit 40D. A low frequency component of the audio signal R output from the input unit 10D successively passes through the delay unit 73R and the LCF 74R via the LPF 72R.

The audio signal SW of the subwoofer channel is input from the input unit 10D to the synthesis unit 75. The synthesis unit 75 synthesizes the audio signal SW with the audio signal output from the LCF 74L and the audio signal output from the LCF 74R. The synthesis unit 75 outputs an audio signal SYNSW resulting from the synthesis to the output unit 40D.

In this manner, in the signal processor 100D, the low frequency components of the audio signal L and the audio signal R of the stereo channels are delayed before being synthesized with the audio signal SW of the subwoofer channel.

Even in a case where the low frequency components of the audio signal L and the audio signal R and the audio signal SW include correlated components, and the audio signal L and the audio signal R are delayed before the synthesis, the LCF 74L and the LCF 74R restrict the level of the low frequency component of the audio signals L and R, and therefore, the amount of a dip occurring in the low frequency range can be reduced in the signal processor 100D.

Needless to say, the signal processor 100D may perform feedback control as that of the synthesis unit 30B illustrated in FIG. 7 for changing the frequency and the amount of a dip occurring at the lowest frequency so as to make the insufficiency in the low frequency range difficult to perceive.

Here, the above embodiments are summarized as follows.

A signal processor of the present disclosure includes: an input unit configured to receive a first audio signal and a second audio signal including mutually correlated components; a delay unit configured to delay the first audio signal received at the input unit by a prescribed delay time; a synthesis unit configured to synthesize the first audio signal having been delayed by the delay unit with the second audio signal received at the input unit, and outputs a third audio signal resulting from synthesis; and a frequency band restriction unit configured to restrict a level of the first audio signal before the synthesis performed by the synthesis unit in a prescribed frequency band including a frequency of a dip occurring at a lowest frequency among a plurality of dips otherwise occurring in a frequency characteristic of the third audio signal as a result of the synthesis performed by the synthesis unit.

In the present disclosure, a dip occurring in the frequency characteristic owing to the synthesis of the first audio signal and the second audio signal refers to a portion where the level drops, as a result of the synthesis, by a prescribed amount (of, for example, 10 dB) or more as compared with that in a frequency characteristic of the first audio signal or the second audio signal. Accordingly, in an exemplified frequency characteristic in which the level drops at 10 Hz by 5 dB, drops at 40 Hz by 15 dB, and drops at 150 Hz by 10 dB, a portion where the level drops at 40 Hz by 15 dB and a portion where the level drops at 150 Hz by 10 dB correspond to dips. In this example, the frequency band restriction unit regards the portion where the level drops at 40 Hz, that is, the lowest frequency, by 15 dB as a target for the frequency band restriction.

Since the frequency band restriction unit restricts the level of the first audio signal in the frequency band including the lowest frequency among those of a plurality of dips, the amount of a dip occurring in this frequency band as a result of the synthesis of the first audio signal and the second audio signal is reduced. In other words, the second audio signal is difficult to change in this frequency band through the synthesis. Thus, in the signal processor of the present disclosure, the amount of a dip occurring in the frequency band including the lowest frequency among those of a plurality of dips is reduced, and hence, a listener can be made difficult to feel insufficiency in a low frequency range.

For example, the signal processor further include: a first level detection unit configured to detect the level of the first audio signal in the prescribed frequency band; and a second level detection unit configured to detect a level of the second audio signal in the prescribed frequency band, and the frequency band restriction unit restricts the level of the first audio signal in the prescribed frequency band if the first level detection unit and the second level detection unit detect a level equal to or higher than a prescribed value.

In other words, if the level of either one of the first audio signal and the second audio signal is lower than the prescribed value in the frequency band including the lowest frequency among those of the plural dips, the frequency band restriction unit does not restrict the level of the first audio signal in this frequency band. Specifically, the frequency band restriction unit restricts the level of the first audio signal in the prescribed frequency band merely when the frequency characteristic of the first audio signal or the second audio signal is largely changed as a result of the synthesis.

Alternatively, according to the present disclosure, the insufficiency in the low frequency range can be suppressed, instead of by using the frequency band restriction unit, by adjusting the delay time of the delay unit. For example, the signal processor of the present disclosure includes an adjustment section configured to determine a dip occurring at a lowest frequency among a plurality of dips occurring in a frequency characteristic of the third audio signal as a result of the synthesis performed by the synthesis unit, and to adjust the prescribed delay time for changing the frequency of the determined dip or reducing an amount of the obtained dip.

The frequency and the amount of a dip are changed if the delay time of the delay unit is changed. The adjustment section adjusts the delay time so that the frequency and the amount of the dip occurring at the lowest frequency can be a frequency and an amount difficult to be perceived by a listener.

For example, the signal processor further include a localization adding unit configured to apply a head-related transfer function to the first audio signal before the synthesis performed by the synthesis unit.

If an audio signal is provided with a head-related transfer function, it is localized as a virtual sound source. By the localization of a virtual sound source, a listener is caused to perceive that the audio signal is localized in the position of the virtual sound source.

The frequency band restriction unit restricts the level of the first audio signal in a frequency band of, for example, 0 Hz to 100 Hz. In other words, the first audio signal provided with the head-related transfer function is retained (is not restricted) in the level in a frequency band of 100 Hz or higher. Since a frequency band of several kHz is dominant in the effect of localizing a virtual sound source on the basis of a head-related transfer function, in this aspect, the signal processor makes it difficult to feel the insufficiency in the low frequency range of 0 Hz to 100 Hz while retaining the virtual sound source localization effect even if the first audio signal and the second audio signal are synthesized.

For example, the prescribed delay time is set to a time not causing an echo derived from the correlated components in the third audio signal.

Since the third audio signal is generated by the synthesis unit through the synthesis of the delayed first audio signal and the second audio signal, it includes the correlated component of one of them and the correlated component of the other shifted correspondingly to the delay time. In this aspect, even if the correlated component is shifted in time, a listener is difficult to feel it as an echo.

What is claimed is:

1. A signal processor, comprising:

an input unit configured to receive a first audio signal and a second audio signal including mutually correlated components;

a delay unit configured to delay the first audio signal received at the input unit by a prescribed delay time;

a synthesis unit configured to synthesize the first audio signal having been delayed by the delay unit with the second audio signal received at the input unit, and outputs a third audio signal resulting from synthesis; and a frequency band restriction unit configured to restrict a level of the first audio signal before the synthesis performed by the synthesis unit in a prescribed frequency band including a frequency of a dip occurring at a lowest frequency among a plurality of dips otherwise occurring in a frequency characteristic of the third audio signal as a result of the synthesis performed by the synthesis unit.

2. The signal processor according to claim 1, further comprising:

a first level detection unit configured to detect the level of the first audio signal in the prescribed frequency band; and a second level detection unit configured to detect a level of the second audio signal in the prescribed frequency band, wherein the frequency band restriction unit restricts the level of the first audio signal in the prescribed frequency band if the first level detection unit and the second level detection unit detect a level equal to or higher than a prescribed value.

3. The signal processor according to claim 1, further comprising:

a localization adding unit configured to apply a head-related transfer function to the first audio signal before the synthesis performed by the synthesis unit.

4. The signal processor according to claim 1, wherein the prescribed delay time is set to a value in the range from 1 ms to 30 ms for not causing an echo derived from the correlated components in the third audio signal.

5. The signal processor according to claim 1, wherein the frequency band restriction unit restricts the level of the first audio signal in a frequency band of 0 Hz to 100 Hz.

6. A signal processing method, comprising:

receiving at an input unit a first audio signal and a second audio signal including mutually correlated components;

delaying the first audio signal received at the input unit by a prescribed delay time;

synthesizing the first audio signal having been delayed in the delaying with the second audio signal received at the input unit, and outputs a third audio signal resulting from synthesis; and restricting a level of the first audio signal before the synthesis performed by the synthesizing in a prescribed frequency band including a frequency of a dip occurring at a lowest frequency among a plurality of dips otherwise occurring in a frequency characteristic of the third audio signal as a result of the synthesis performed by the synthesizing.

7. The signal processing method according to claim 6, further comprising:

detecting the level of the first audio signal in the prescribed frequency band; and detecting a level of the second audio signal in the prescribed frequency band, wherein in the restricting, the level of the first audio signal in the prescribed frequency band is restricted if a level equal to or higher than a prescribed value is detected in the detecting of the level of the first audio signal or the level of the second audio signal.

8. The signal processing method according to claim 6, further comprising:

applying a head-related transfer function to the first audio signal before the synthesis performed by the synthesizing.

9. The signal processing method according to claim 6, wherein the prescribed delay time is set to a value in the range from 1 ms to 30 ms for not causing an echo derived from the correlated components in the third audio signal.

10. The signal processing method to claim 6, wherein in the restricting, the level of the first audio signal is restricted in a frequency band of 0 Hz to 100 Hz.

* * * * *